US009657487B2

(12) United States Patent
Colletto

(10) Patent No.: US 9,657,487 B2
(45) Date of Patent: May 23, 2017

(54) WATER OVERFLOW EDGE DEVICE FOR A SWIMMING POOL AND RELATIVE IMPROVED STRUCTURAL ELEMENT

(71) Applicant: A & T EUROPE S.p.A, Castiglione delle Stiviere (MN) (IT)

(72) Inventor: Roberto Colletto, Padenghe sul Garda (IT)

(73) Assignee: A&T EUROPE S.P.A., Castiglione Delle Stiviere (MN) (IT)

( * ) Notice: Subject to any disclaimer, the term of this patent is extended or adjusted under 35 U.S.C. 154(b) by 0 days.

(21) Appl. No.: 14/917,493

(22) PCT Filed: Sep. 25, 2014

(86) PCT No.: PCT/IB2014/064824
§ 371 (c)(1),
(2) Date: Mar. 8, 2016

(87) PCT Pub. No.: WO2015/044888
PCT Pub. Date: Apr. 2, 2015

(65) Prior Publication Data

US 2016/0215514 A1 Jul. 28, 2016

(30) Foreign Application Priority Data

Sep. 26, 2013 (IT) ..... MI2013A1588

(51) Int. Cl.
*E04H 4/00* (2006.01)
*E04H 4/12* (2006.01)
*E04H 4/14* (2006.01)

(52) U.S. Cl.
CPC ..... *E04H 4/1227* (2013.01); *E04H 4/141* (2013.01)

(58) Field of Classification Search
CPC ..... E04H 4/1227
(Continued)

(56) References Cited

U.S. PATENT DOCUMENTS 3,668,714 A * 6/1972 Baker ..... E04H 4/1227 210/167.12
4,007,566 A * 2/1977 Molitor ..... E04H 4/1227 4/510

(Continued)

FOREIGN PATENT DOCUMENTS

DE 29802829 U1 4/1998
EP 1518975 A1 3/2005

OTHER PUBLICATIONS

International Search Report and Written Opinion for International Application No. PCT/IB2014/064824.(Jan. 8, 2015)(10 pages).

*Primary Examiner* — Huyen Le
(74) *Attorney, Agent, or Firm* — Lucas & Mercanti, LLP

(57) ABSTRACT

A water overflow edge device for a swimming pool is having a channel consisting of bottom, rear and front walls is disclosed. The front wall is made of a plurality of modular structural elements arranged in sequence and coupled together "end-to-end". The channel is also covered on top by a walking grid that allows swimming pool water to enter. Each modular structural element has a first component with structural function, provided at the bottom with coupling means with the bottom wall of the channel and with the top of the vertical inner wall of the swimming pool. The structural component includes at one side with a first surface, which forms the front wall of the channel, and with a second substantially vertical surface, opposite the first surface and configured to support a second coating component which forms the entire exposed surface of the water overflow edge device and which has a finishing function. Preferably, the first component is plastic and the second coating component is ceramic.

12 Claims, 6 Drawing Sheets

(58) Field of Classification Search
USPC ..... 4/510
See application file for complete search history.

(56) References Cited

U.S. PATENT DOCUMENTS

| | | | | | |
|---|---|---|---|---|---|
| 4,050,104 | A * | 9/1977 | Baker | ..... | E04H 4/1227 4/510 |
| 4,235,008 | A | 11/1980 | Meredith | | |
| 4,758,292 | A * | 7/1988 | Baker | ..... | E04H 4/1227 156/196 |
| 9,540,836 | B2 * | 1/2017 | Baker | ..... | E04H 4/1227 |

* cited by examiner

WATER OVERFLOW EDGE DEVICE FOR A SWIMMING POOL AND RELATIVE IMPROVED STRUCTURAL ELEMENT

CROSS-REFERENCE TO RELATED APPLICATIONS

This application is a 371 of PCT/IB2014/064824, filed Sep. 25, 2014, which claims the benefit of Italian Patent Application No. MI2013A001588, filed Sep. 26, 2013.

FIELD OF THE INVENTION

The present invention in general refers to a water overflow edge device for a swimming pool and, more in particular, to an improved structural element for such a water overflow edge, which can be preferably but not exclusively used on a prefabricated swimming pool.

BACKGROUND OF THE INVENTION

Most swimming pools, both in-ground, and above ground, are provided with a system for recirculating water the function of which is to recover water contained in the swimming pool, send it to a filtration system, disinfect it and then introduce it again into the swimming pool itself. One of such systems, the so called water overflow edge system, is provided with a pump system that draws water from a compensation tank and reintroduces it inside the swimming pool through inlet fittings arranged on the vertical walls or on the bottom of the swimming pool itself.

The swimming pool is provided with a total or partial peripheral channel, in which water overflows or, in other words, pours out passing over the upper edge of the vertical walls of the swimming pool itself. The water that overflows into the peripheral channel flows by gravity towards a plurality of discharge outlets, also known as "drains", usually arranged at the bottom of the channel or in any case in a low position. From the drains, through piping connected to them and with suitable collectors, the water reaches the compensation tank. The compensation tank, in addition to being used for containing the water reserve that is necessary for supplying the pumps of the filtration system when there are no users in the swimming pool, is also used for storing the volume of water corresponding to that which overflows into the peripheral channel consequently to the entrance in the swimming pool of possible users.

In prefabricated swimming pools of the conventional type, usually built in metal and coated with a plastic membrane (typically PVC), the peripheral channel of the water overflow edge is in general entirely made with the same material which forms the walls of the swimming pool, that is to say metal coated with a plastic membrane. The peripheral channel is usually shaped in a complex manner, with a section that often also has two steps on the opposite vertical sides. These steps are intended for supporting a walking grid that for safety reasons covers the peripheral channel.

This type of peripheral channel for a water overflow edge is particularly complex and costly due to the numerous folds to be made in the metal during production. It is consequently difficult to build swimming pools with walls having curves, that is to say not rectilinear. A curved water overflow edge cannot indeed be made with channels formed by a single sheet of metal. A curved water overflow edge does, on the other hand, require many components that are suitably shaped to be assembled, with a high chance of water leaking due to the presence of numerous joints in the metal structure.

Water overflow edges have therefore been made for swimming pools in which the peripheral channel is provided with modular structural elements manufactured with materials other than metal. Embodiments of a similar water overflow edge are described, for example, in patent IT 1374335 to the same Applicant, as well as in documents EP 1 518 975 A1 and U.S. Pat. No. 4,235,008 A. This water overflow edge comprises a channel that, at the front, consists of a plurality of structural elements made of ceramic material, which are configured for coupling with one another "end-to-end" and for being, at the bottom, fixed to the bottom of the channel and/or to the inner wall of the swimming pool. On each structural element made of ceramic material there is thus a support portion that is obtained for supporting the walking grid.

Also this second type of peripheral channel for a water overflow edge is not without drawbacks, in particular concerning the structural element made of ceramic material. Following the production of numerous structural elements in ceramic material, as well as multiple installations of peripheral channels comprising such structural elements, in swimming pools of various kinds, the following problems were found:

- difficulty in making the structural element in ceramic material, since it is massive and heavy;
- a reduced dimensional stability of the structural element in ceramic material following the relative extrusion process, due to its great weight;
- the possibility of deformation of the structural element in ceramic material in its drying phase;
- long and energy-consuming drying for the conspicuous mass of the structural element in ceramic material;
- difficulty for the structural element in ceramic material to completely dry, with the occurrence in its central core of the phenomenon called in jargon "black core";
- the possibility of high absorption of humidity by the peripheral channel, with a consequent reduction of the anti-freeze properties or, in other words, resistance to the frost disintegrating action;
- high percentage of waste and high cost.

SUMMARY OF THE INVENTION

The purpose of the present invention is therefore that of making a water overflow edge device for a swimming pool and, more in particular, an improved structural element for such a water overflow edge that are capable of solving the drawbacks mentioned above with reference to the prior art in an extremely simple, cost-effective and particularly functional manner.

In detail, one purpose of the present invention is to make a water overflow edge device for a swimming pool that is particularly solid and resistant, while being relatively light.

Another purpose of the present invention is that of making a water overflow edge device for a swimming pool that is simple to manufacture, as well as to install by using conventional methods.

A further purpose of the present invention is to make a water overflow edge device for a swimming pool that can also be easily adapted to swimming pools that are provided with walls having any curvilinear shape.

These purposes according to the present invention are achieved by making a water overflow edge device for a swimming pool and, more in particular, an improved structural element for such a water overflow edge as outlined in claim 1.

Further characteristics of the invention are highlighted in the dependent claims, which are an integral part of the present description.

BRIEF DESCRIPTION OF THE DRAWINGS

The characteristics and the advantages of a water overflow edge device for a swimming pool according to the present invention shall become clearer from the following description, given as an example and not for limiting purposes, with reference to the attached schematic drawings, in which.

DETAILED DESCRIPTION OF THE INVENTION

Figure 1:
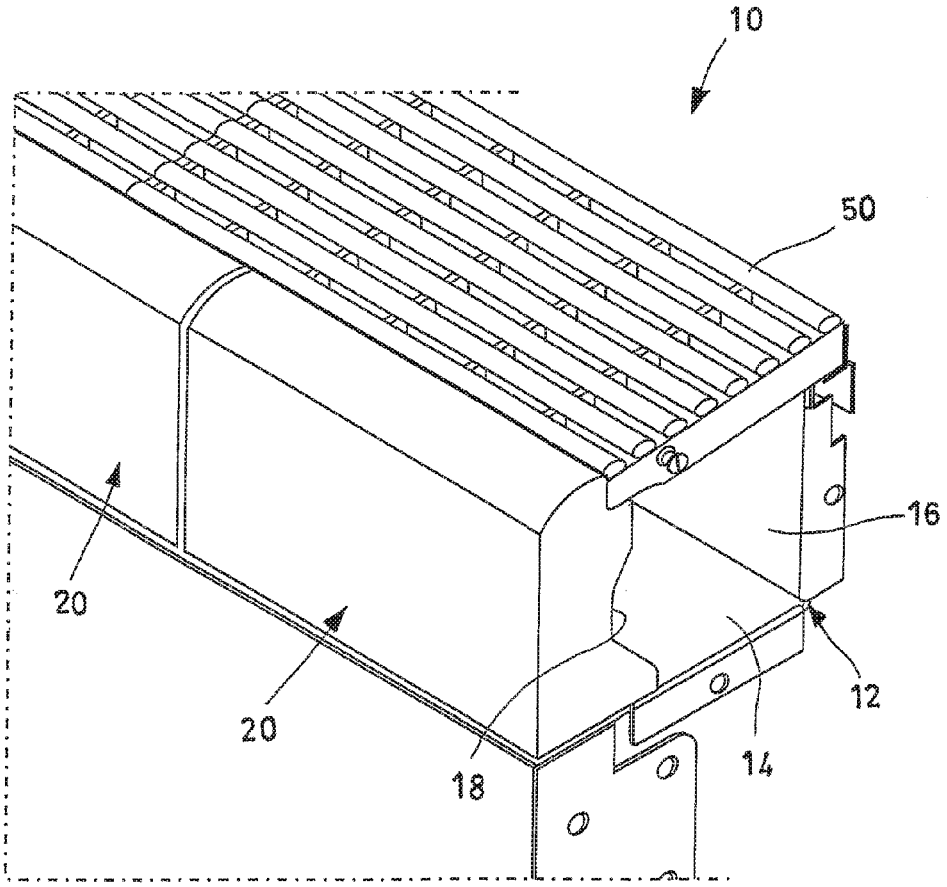
FIG. 1 is a schematic perspective view of a water overflow edge device for swimming pools made according to the prior art.
Figure 2:
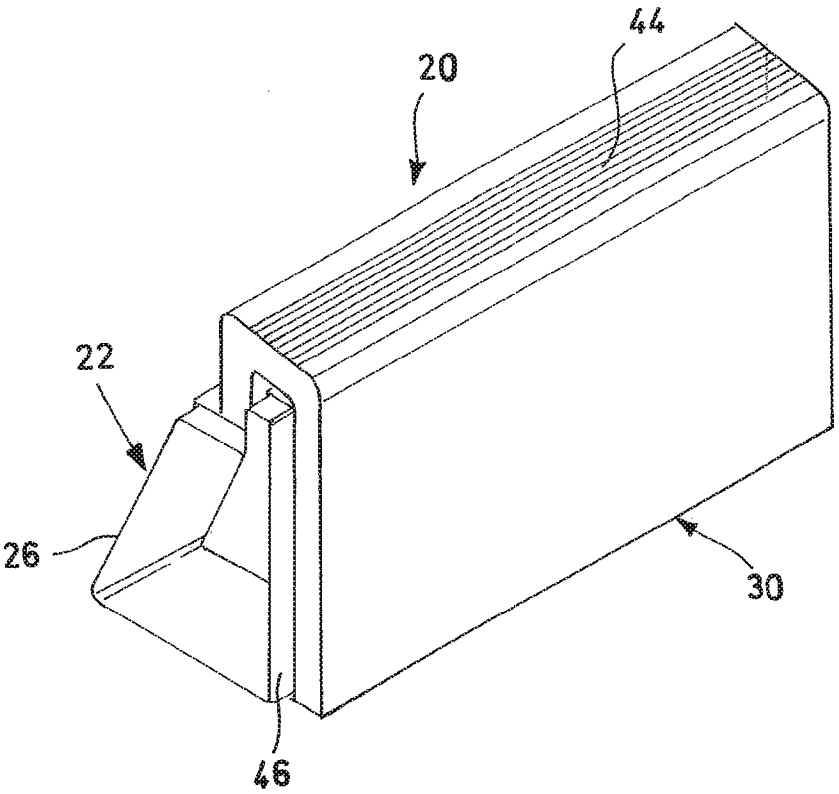
FIG. 2 is a perspective view of a preferred embodiment of a structural element for a water overflow edge according to the present invention.

With reference in particular to FIG. 1, a generic water overflow edge device for swimming pools is shown, wholly indicated with reference numeral 10. The water overflow edge device 10 comprises, in a per se known manner, a channel 12 that substantially consists of a bottom wall 14, a rear wall 16 and a front wall 18 that is obtained with a plurality of modular structural elements 20 arranged in sequence and coupled together "end-to-end". The channel 12 is also covered on top by a walking grid 50 that allows water of the swimming pool to enter into the channel 12 itself.

According to the invention, with reference to figures from 2 to 6, each modular structural element 20 consists of a first component 22 in plastic material with structural function, provided at the bottom with coupling means 24 with the bottom wall 14 of the channel 12 and/or with the top of the vertical inner wall of the swimming pool. The structural component 22 is moreover provided at one side with a first surface 26, which forms the front wall 18 of the channel 12, and with a substantially vertical second surface 28, opposite the first surface 26 and configured to support a second coating component 30 in ceramic material, which forms the entire exposed surface of the water overflow edge device 10 and that has a finishing function.

The structural component 22 is moreover provided, at the top, between the first surface 26 and the second surface 28, both with a substantially horizontal support portion 32, which is designed to support the walking grid 50, and with a substantially convex coupling portion 34, which is designed to be shape-coupled with a corresponding concave portion 36 of the coating component 30 in ceramic material.

Figure 4:
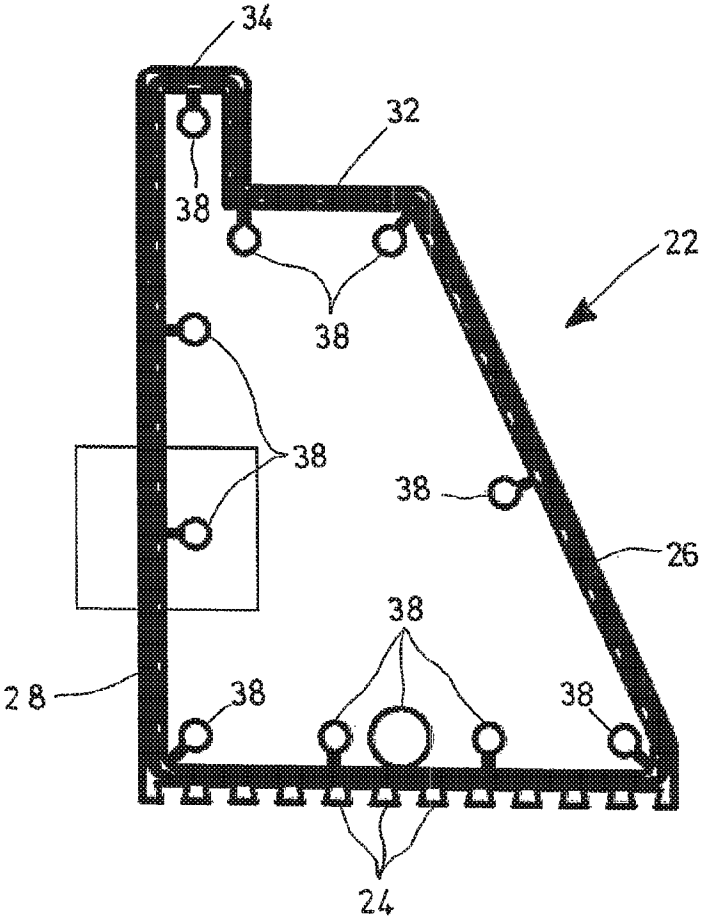
FIG. 4 is a cross section view of the component of FIG. 3.

The coupling means 24 of the structural component 22 are preferably made up of a plurality of male-female couplers (FIG. 4), which are capable of being coupled together by interlocking and/or through gluing with adhesive materials along the upper edge of the swimming pool, so that the coating component 30 of each modular structural element 20 is aligned with the vertical inner wall of such a swimming pool. Between the male-female couplers 24 suitable clearances are made so as to allow channels 12 having profiles with a broken line to be laid, so as to closer approximate curved walls. For each modular structural element 20 there are standard lengths equal to 250 mm and 125 mm, so as to best approximate small bending radii in accordance with the market standards for tiles in the field of swimming pools.

Preferably, the structural component 22 in plastic material is made in the form of a profile with an internally hollow continuous cross section. The structural component 22 can be, on the inside, provided with one or more reinforcing ribs 38 (FIG. 4), arranged longitudinally, and/or with one or more reinforcing dividers 40 (FIG. 3), arranged transversally and therefore perpendicular to such reinforcing ribs 38.

The plastic material of the structural component 22 can advantageously consist of ABS (acronym of acrylonitrile-butadiene-styrene), or any other suitable thermoplastic polymer. The first surface 26 of the structural component 22 can advantageously be inclined according to an angle of over 90° with respect to the bottom wall 14 of the channel 12 so as to facilitate the outflow of water towards such a bottom wall 14.

Figure 5:
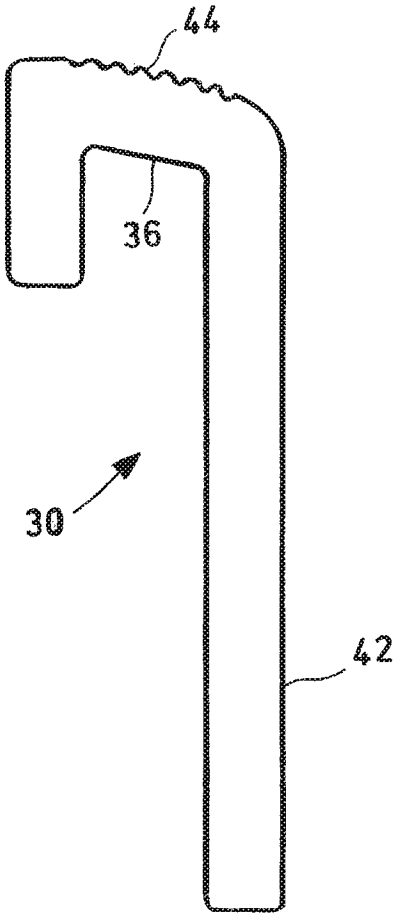
FIG. 5 is a cross section view of a second component of the structural element of FIG. 2.

The coating component 30 in ceramic material is preferably made with a shape in section like an inverted J (FIG. 5), with a vertical front wall 42 exposed towards the inside of the swimming pool. The vertical front wall 42 has the concave portion 36 on top of it, which substantially has a C-shaped section and that is intended for hooking onto the structural component 22. The upper surface of the concave portion 36, which in the embodiment of the water overflow edge device 10 illustrated in the attached figures is configured to be substantially aligned with the walking grid 50, can advantageously be provided with a plurality of longitudinal grooves 44 with a finger-grip function for the swimmer. In another example embodiment of the water overflow edge device 10 the upper surface of the concave portion 36 could be configured so as to protrude upwards with respect to the plane defined by the walking grid 50. In such a way, for swimming pools in which, according to the standards, it is required, or in any case it is suitable, for there to be a so-called "finger hold", the protrusion can define a finger grip for the swimmer who wishes to holding on to it or who needs to rest.

During the installation of the water overflow edge device 10 each structural component 22 of the modular structural element 20 is laid on a suitable layer of adhesive material, pre-emptively applied at the peripheral edge of the swimming pool. Between the peripheral edge of the swimming pool and each structural component 22 shim layers can be possibly applied (not shown) for keeping such a structural component 22 at the correct level necessary for ensuring an effective overflow of water into the channel 12.

Figure 3:
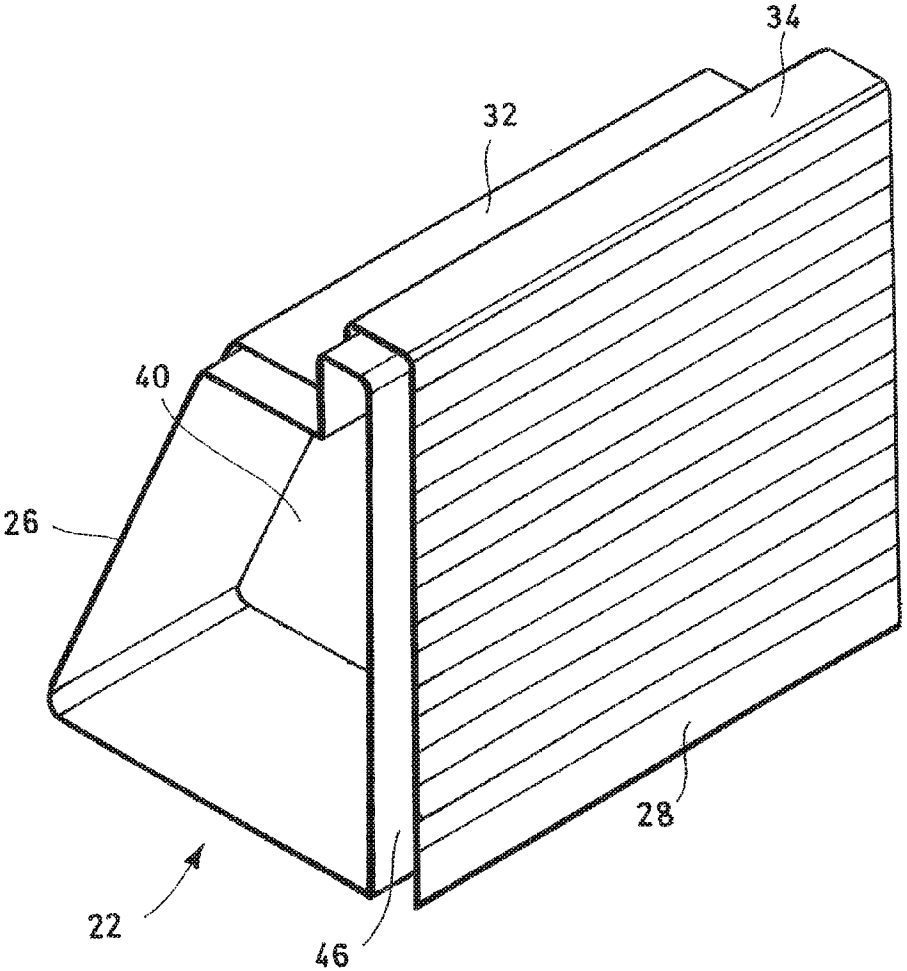
FIG. 3 is a perspective view of a first component of the structural element of FIG. 2.

The structural components 22 of the modular structural element 20, once they have been arranged side by side on the peripheral edge of the swimming pool, can be sealed to one another with suitable sealants, so as to ensure the hold of the entire front structure of the channel 12 and to prevent water from leaking in the two directions. As shown in FIG. 3, each structural component 22 can be provided with a second surface 28 finished with front grooves, as well as dovetailed male-female couplers 24, so as to ensure a suitable stick of the adhesive materials.

In order to ensure that there is a stable coupling between the various structural components 22 arranged in sequence, on one of the transversal or "top" edges of each structural component 22 a protrusion 46 can be made (FIG. 3) that is configured so as to be inserted into a corresponding groove 48 (FIG. 6) made on the transversal or "top" edge opposite such a structural component 22. It is therefore possible to couple through interlocking, as well as by using glues and/or sealants, the various pairs of contiguous structural components 22.

The coating component 30 in ceramic material, despite being specifically shaped in the manner described in the present description, is substantially similar in dimensions to a standard tile. The coating component 30 can indeed be made with lengths equal to 245 mm and 122 mm so that, by considering the average thicknesses of the "gaps" which are made during installation between coating components 30 adjacent to one another, it is possible to obtain the standard modularities of 250 mm and 125 mm described above. The "gaps" between adjacent coating components 30 can be filled with standard methods and systems of the field of laying tiles, like for example with epoxy mortars.

Figure 6:
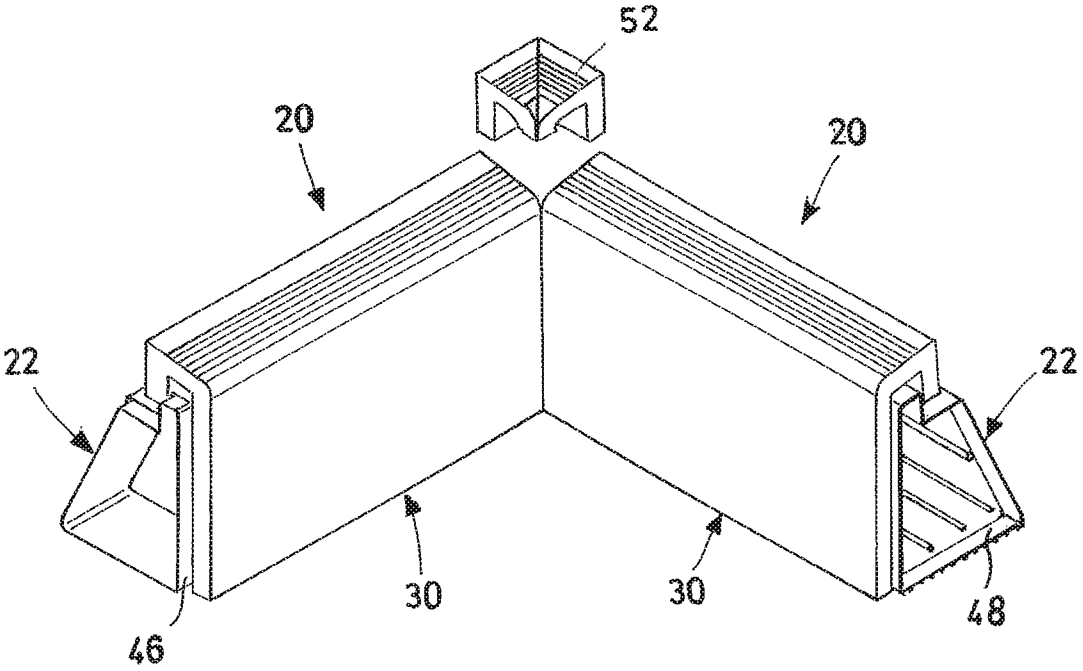
FIG. 6 is a perspective view showing a particular installation of the structural elements of FIG. 2.

In the joining step between each coating component and the respective structural component 22 below, which is typically obtained through gluing in addition to shape-coupling, it is possible to introduce a further layer of thickness (that is not shown) so as to reduce the tolerance of the overflow profile, which coincides with the upper surface of the concave portion 36 of each coating component 30. As shown in FIG. 6, the joining of modular structural elements 20 at angles with any width, below or above 90°, can be carried out with the help of special angular components 52 which complete the upper walking profile of the water overflow edge device 10.

It has thus been seen that the water overflow edge device for a swimming pool according to the present invention obtains the purposes that were previously highlighted. In terms of its appearance, the end result of the laying of a similar water overflow edge device is completely suitable, since the finishing of the exposed surfaces is actually obtained with materials in valuable ceramic. Also the part facing towards inside the channel, consisting of the visible rear surface of the structural components, has an acceptable appearance since it is hidden from the walking grid that closes the channel of the water overflow edge.

It is worth underlining that the structural component of each modular structural element, suitably modified in its section, could be coated, on its front and top surfaces, with a mosaic coating component rather than in ceramic, with tiles having different sizes according to the requirement, typically 20×20 mm. In such a way a different and potentially more valuable kind of finishing would be obtained for the water overflow edge device.

The water overflow edge device for a swimming pool of the present invention thus conceived can in any case undergo numerous modifications and variants, all covered by the same inventive concept; moreover, all the details can be replaced by technically equivalent elements. In practice the materials used, as well as the shapes and sizes, may be any according to the technical requirements.

The scope of protection of the invention is thus defined by the attached claims.

The invention claimed is:

1. Water overflow edge device for a swimming pool, comprising a channel having a bottom wall, a rear wall and a front wall, wherein said front wall is made of a plurality of modular structural elements arranged in sequence and coupled together "end-to-end", the channel also being covered on top by a walking grid that allows water from the swimming pool to enter into said channel wherein, each modular structural element has a first component with structural function, provided at the bottom with coupling means with the bottom wall of the channel and/or with the top of the vertical inner wall of the swimming pool, said structural component also being provided at one side with a first surface, which forms the front wall of the channel, and with a second substantially vertical surface, opposite the first surface and configured to support a second coating component which forms the entire exposed surface of the water overflow edge device and which has a finishing function.

2. Water overflow edge device according to claim 1, wherein, the first component with structural function is provided at the top, between the first surface and the second surface, both with a substantially horizontal support portion, designed to support the walking grid, and with a substantially convex coupling portion, designed to be shape-coupled with a corresponding concave portion of the second coating component.

3. Water overflow edge device according to claim 2, wherein, the first component with structural function is made of a plastic material and the second coating component is made of a ceramic material.

4. Water overflow edge device according to claim 3, wherein the coupling means of the first component with structural function includes a plurality of male-female couplers, capable of being coupled together by interlocking and through gluing with adhesive materials along the upper edge of the swimming pool, so that the second coating component of each modular structural element is aligned with the vertical inner wall of said swimming pool, wherein between said male-female couplers there are corresponding clearances so as to allow channels to be laid with profiles having a broken line.

5. Water overflow edge device according to claim 4, wherein the first component with structural function is provided with a second surface finished with front grooves, as well as with dovetailed male-female couplers, so as to ensure a suitable stick of the adhesive materials.

6. Water overflow edge device according to claim 3, wherein the first component with structural function is made in the form of a profile with an internally hollow continuous cross section.

7. Water overflow edge device according to claim 6, wherein the first component with structural function is internally provided with one or more reinforcing ribs, arranged longitudinally, and/or with one or more reinforcing dividers, arranged transversally and thus perpendicular to said reinforcing ribs.

8. Water overflow edge device according to claim 6, wherein the first surface of the first component with structural function is inclined according to an angle of over 90° with respect to the bottom wall of the channel, so as to facilitate the outflow of water towards said bottom wall.

9. Water overflow edge device according to claim 3, wherein on one of the transversal or "top" edges of each first component with structural function a protrusion is made that is configured to insert into a corresponding groove made on the opposite transversal or "top" edge of said first component with structural function, so as to ensure a stable coupling between the various components with structural function arranged in sequence.

10. Water overflow edge device according to claim 3, wherein the second coating component is made with a shape in section like an inverted J, with a vertical front wall exposed towards the inside of the swimming pool and wherein said vertical front wall has said concave portion on top of it, said concave portion having a substantially C-shaped section.

11. Water overflow edge device according to claim 10, wherein the upper surface of said concave portion is configured to be substantially aligned with the walking grid and is provided with a plurality of longitudinal grooves with a finger-grip function for the swimmer.

12. Water overflow edge device according to claim 10, wherein the upper surface of said concave portion is configured to extend upwards with respect to the plane defined by the walking grid, so that the projection forms a finger-hold for the swimmer.

* * * * *